US012404145B2

(12) United States Patent
Wang et al.

(10) Patent No.: US 12,404,145 B2
(45) Date of Patent: Sep. 2, 2025

(54) CONDUIT RETRACTOR

(71) Applicant: Beijing Kohler Ltd., Beijing (CN)

(72) Inventors: Xiugui Wang, Beijing (CN); Peng Zhang, Beijing (CN); Hui Li, Beijing (CN); Guang Cheng, Beijing (CN)

(73) Assignee: BEIJING KOHLER LTD., Beijing (CN)

( * ) Notice: Subject to any disclaimer, the term of this patent is extended or adjusted under 35 U.S.C. 154(b) by 207 days.

(21) Appl. No.: 18/309,986

(22) Filed: May 1, 2023

(65) Prior Publication Data

US 2023/0356974 A1 Nov. 9, 2023

(30) Foreign Application Priority Data

May 9, 2022 (CN) ..... 202221101659.2

(51) Int. Cl.
*B65H 75/48* (2006.01)
*B65H 75/44* (2006.01)

(52) U.S. Cl.
CPC ..... *B65H 75/4434* (2013.01); *B65H 75/486* (2013.01); *B65H 2701/33* (2013.01)

(58) Field of Classification Search
CPC ... B65H 75/48; B65H 75/486; B65H 75/4434
See application file for complete search history.

(56) References Cited

U.S. PATENT DOCUMENTS

| | | | | |
|---|---|---|---|---|
| 9,890,013 | B2 * | 2/2018 | Chen | B65H 75/4434 |
| 2006/0011763 | A1 * | 1/2006 | Kuo | B65H 75/4434 242/378.1 |
| 2006/0027433 | A1 * | 2/2006 | Wu | H02G 11/02 191/12.2 R |
| 2007/0181730 | A1 * | 8/2007 | Yen | B65H 75/4442 242/378.1 |
| 2013/0099044 | A1 * | 4/2013 | He | B65H 75/48 242/388 |
| 2015/0144728 | A1 * | 5/2015 | Chen | B65H 75/48 242/375 |
| 2015/0144729 | A1 * | 5/2015 | Chen | B65H 75/4434 242/377 |
| 2020/0399093 | A1 * | 12/2020 | Masaki | B65H 75/4471 |

* cited by examiner

*Primary Examiner* — Sang K Kim
(74) *Attorney, Agent, or Firm* — FOLEY & LARDNER LLP

(57) ABSTRACT

A retractor assembly includes a housing, a cover, a rotary plate, a swing arm, an outlet pipe, and an elastic drive member. The housing includes a cavity. The rotary plate is pivotally mounted within the cavity. The swing arm is pivotally mounted and includes a guide protrusion. The elastic drive member is configured to bias the rotary plate toward a reset position. A side of the rotary plate includes an outer guide groove and in inner guide groove. A first channel and a second channel span between the outer guide groove and the inner guide groove. The guide protrusion is configured to enter the inner guide groove from the outer guide groove via the first channel, and enter the outer guide groove from the inner guide groove via the second channel. The second channel includes a locking groove therein configured to catch the guide protrusion.

20 Claims, 6 Drawing Sheets

CONDUIT RETRACTOR

CROSS-REFERENCE TO RELATED APPLICATION

This application claims the benefit of and priority to Chinese Patent Application No. 202221101659.2, filed on May 9, 2022, the disclosure of which is incorporated herein by reference in its entirety.

FIELD

The application relates to the technical field of retracting devices and utility conduit management. More specifically, the application relates to tensioners, retractors, and drawing mechanisms for fluid conduits.

BACKGROUND

A faucet can include a faucet body and a faucet outlet. The faucet outlet can be coupled to a fluid conduit that is configured to slide within the faucet body. A length of the fluid conduit may at least partially protrude from a first end of the faucet body (e.g., an above sink end) and/or a second end of the faucet body (e.g., under sink end, a base end, etc.). The faucet outlet may be removably coupled to the faucet body in a first position in which a length of fluid conduit protrudes from the second end of the faucet body. The faucet outlet may be displaced from the faucet body in a second position in which a length of fluid conduit protrudes from the first end of the faucet body and spans between the faucet body and faucet outlet.

SUMMARY

At least one embodiment relates to a retractor assembly including a housing, a cover, a rotary plate, a swing arm, an outlet pipe, and an elastic drive member. The housing includes a cavity. The cover is coupled to the housing and includes an inlet channel. The rotary plate is pivotally mounted within the cavity. The swing arm is pivotally mounted within the cavity and includes a guide protrusion. The elastic drive member is mounted within the cavity and is configured to bias the rotary plate toward a reset position. A first end of the outlet pipe is fluidly coupled with the inlet channel. A second end of the outlet pipe passes through the housing. A side of the rotary plate includes an outer guide groove and in inner guide groove. A first channel and a second channel span between the outer guide groove and the inner guide groove. The guide protrusion is configured to enter the inner guide groove from the outer guide groove via the first channel. The guide protrusion is configured to enter the outer guide groove from the inner guide groove via the second channel. The second channel includes a locking groove therein configured to catch the guide protrusion.

Another embodiment relates to a retractor assembly for a plumbing conduit. The retractor assembly includes a housing, a cover, a spool, a swing arm, a fluid conduit, and an elastic drive member. The housing includes a cavity. The cover is coupled to the housing and includes an inlet channel. The spool is pivotally mounted within the cavity and is configured to rotate about a spool axis. The swing arm is pivotally mounted within the cavity and includes a guide protrusion. The fluid conduit is wound on the spool and includes a first end coupled to the inlet channel. The elastic drive member is mounted within the cavity and is configured to bias the spool to rotate about the spool axis toward a reset position. The fluid conduit passes through a hole in the housing between the first end and a second end of the fluid conduit. A side of the spool includes a first annular guide groove, a second annular guide groove, a first channel, and a second channel. The first channel spans between the first annular guide groove and the second annular guide groove. The second channel spans between the first annular guide groove and the second annular guide groove. The guide protrusion is configured to enter the first annular guide groove from the second annular guide groove via the first channel. The guide protrusion is configured to enter the second guide groove from the first guide groove via the second channel. The second channel includes a bend therein configured to catch the guide protrusion within the second channel.

Another embodiment relates to a retractor assembly includes a housing, a spool, a spring, and a follower arm. The spool is configured to pivot about a spool axis within the housing. The spool includes a side including a first annular guide groove concentric with the spool axis, a second annular guide groove concentric with the spool axis, a first channel spanning between the first annular guide groove and the second annular guide groove, and a second channel spanning between the first annular guide groove and the second annular guide groove. The second channel includes a bend. The spring is configured to bias the spool to rotate around the spool axis toward a reset position. The follower arm is pivotally coupled within the housing and includes a guide protrusion configured to slide within the first annular guide groove, the second annular guide groove, the first channel, and the second channel. The guide protrusion enters the first channel from the first annular guide groove when the spool is rotated in a first direction. The guide protrusion enters the second channel from the second annular guide groove when the spool is rotated in a second direction opposite the first direction.

Another embodiment relates to a pipe drawing mechanism including a housing with a holding cavity, a top cover mounted on the housing and having an inlet channel, a rotary plate pivotally mounted in the holding cavity, a swing arm pivotally mounted in the holding cavity and having a guide protrusion, an outlet pipe wound on the rotary plate and an elastic drive member mounted in the holding cavity and used to drive the rotary plate to reset; one end of the outlet pipe is connected with the inlet channel and other end of the outlet pipe passes through the holding cavity; one side of the rotary plate that facing the swing arm has an outer guide groove and an inner guide groove which are in clearance fit with the guide protrusion; a first channel and a second channel are connected between the outer guide groove and the inner guide groove at intervals, the guide protrusion is able to enter the inner guide groove from the outer guide groove via the first channel and the guide protrusion is able to enter the outer guide groove from the inner guide groove via the second channel; and the second channel has a locking groove therein for locking the guide protrusion.

In some embodiments, the locking groove is a bending groove provided in the second channel.

In some embodiments, the guide protrusion is a guide cylinder.

In some embodiments, a bottom plate of the housing has a connection column, one end of the swing arm is pivotally mounted on the connection column.

In some embodiments, a terminal end of the swing arm has a support end extending towards the bottom plate, the support end is on the bottom plate.

In some embodiments, the rotary plate includes a circular groove, the outlet pipe is wound in the circular groove.

In some embodiments, the rotary plate is fitted with an adapter connected to the inlet channel, one end of the outlet pipe is connected to the adapter.

In some embodiments, the adapter including an adapting pipe and a pipe fitting attached to one side of the adapting pipe; the rotary plate has a central sleeve in the central part, one side of the central sleeve has a sleeve notch; and the adapting pipe is installed in the central sleeve and communicated with the inlet channel, the pipe fitting protrudes from the sleeve notch and is connected with the outlet pipe.

In some embodiments, a bottom of the top cover has an insert-pipe connected with the inlet channel, the insert-pipe is inserted in the adapting pipe.

In some embodiments, a bottom of the rotary plate has a storage groove, the elastic drive member is located in the storage groove.

In some embodiments, when the outlet pipe is drawn outward, the rotary plate rotates in the positive direction and compresses the elastic driving member, and the guide protrusion enters the inner guide groove from the outer guide groove via the first channel. In some embodiments, after the user stops drawing the outlet pipe, the user can release the outlet pipe, and under the action of the elastic drive member, the rotary plate starts to rotate in the reverse direction and drive the outlet pipe to retract a certain length. In some embodiments, the guide protrusion enters the locking groove of the second channel from the inner guide groove to prevent the rotary plate from rotating in the reverse direction, and the outlet pipe is locked and no longer retracted. In some embodiments, when the user needs to retract and collect the outlet pipe, the user can draw the outlet pipe again, the guide protrusion leaves the locking groove and enter the outer guide groove. In some embodiments, the outlet pipe is retracted automatically after the user releases it.

This summary is illustrative only and should not be regarded as limiting.

DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
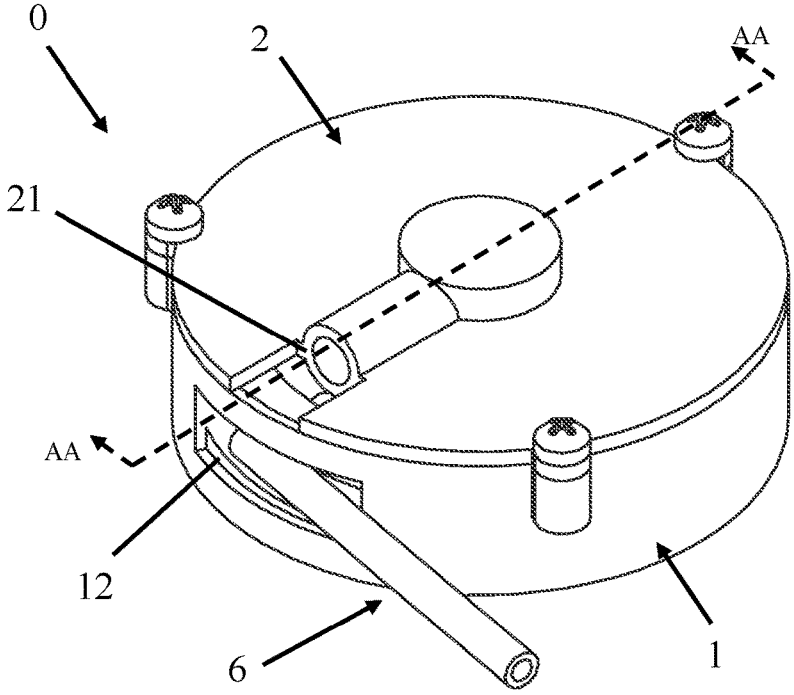
FIG. 1 is a front, right, top perspective view of a pipe drawing mechanism, according to some embodiments.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting. The various concepts introduced above and discussed in greater detail below may be implemented in any number of ways, as the described concepts are not limited to any particular manner of implementation. Examples of specific implementations and applications are provided primarily for illustrative purposes.

Embodiments of the application are further described below with reference to the accompanying figures, wherein like reference numerals refer to like elements. It should be noted that, terms as used in the following description, "front", "rear", "left", "right", "up" and "down" indicate a direction in the figures, and terms "inner" and "outer" respectively indicate the direction towards or away from a geometric center of a particular part.

A faucet can include a faucet body and a faucet outlet. The faucet outlet may be coupled to a fluid conduit that is configured to slide within the faucet body. A length of the fluid conduit may at least partially protrude from a first end of the faucet body (e.g., an above sink end) and/or a second end of the faucet body (e.g., under sink end, a base end, etc.). The faucet outlet may be removably coupled to the faucet body in a first position in which a length of fluid conduit protrudes from the second end of the faucet body. The faucet outlet may be displaced from the faucet body in a second position in which a length of fluid conduit protrudes from the first end of the faucet body and spans between the faucet body and faucet outlet.

A user can draw the fluid conduit (e.g., pipe, hose, flexible tubing, water pipe, water hose, etc.) from the faucet body to adjust the length of the fluid conduit, so that the position and angle of the faucet outlet relative to the faucet body can be adjusted, which is convenient to use.

The fluid outlet and fluid conduit may be biased from the second position (e.g., the pulled-out position, the pulled-down position, the extended position, etc.) toward the first position (e.g., a home position, a compact position, a docked position, etc.) by a retractor. A retractor can include a weight suspended along a length of the fluid conduit that pulls the fluid conduit through the faucet body (e.g., as the weight falls). However, such retractors are burdensome and difficult to use. For example, the biasing force of the retractor must be overcome and sustained in order to maintain the faucet outlet in the second position. For example, a user may pull on the faucet outlet (e.g., which may lift the weight) and overcome the biasing force. However, when a user does not overcome the biasing force of the retractor (e.g., does not continue to pull on the faucet outlet), the retractor retrieves the fluid conduit through the faucet body.

When a typical water pipe drawing mechanism is in use, users need to keep drawing the water pipe to avoid retraction of the water pipe, which is inconvenient to use.

The application aims to provide a retractor assembly to overcome the shortcomings of the prior art, such as burdensome positioning and strenuous drawing. Aiming at the technical problems, the application provides the following technical solutions.

The application discloses a pipe drawing mechanism including a housing, a top cover, a rotary plate, a swing arm with a guide protrusion, an outlet pipe and an elastic drive member; a side of the rotary plate facing the swing arm is provided with an outer guide groove and an inner guide groove which are in clearance fit with the guide protrusion; a first channel and a second channel are connected between the outer guide groove and the inner guide groove at intervals, the guide protrusion can enter the inner guide groove from the outer guide groove via the first channel, and the guide protrusion can enter the outer guide groove from the inner guide groove via the second channel; the second channel has a locking groove therein for locking the guide protrusion. The pipe drawing mechanism of the application has locking function and is convenient for users to use.

An object of the application is to overcome the shortcomings of the prior art and provide a pipe drawing mechanism with locking function.

A technical solution of the application provides a pipe drawing mechanism including a housing with a holding cavity, a top cover mounted on the housing and having an inlet channel, a rotary plate pivotally mounted in the holding cavity, a swing arm pivotally mounted in the holding cavity and having a guide protrusion, an outlet pipe wound on the rotary plate and an elastic drive member mounted in the holding cavity and used to drive the rotary plate to reset; one end of the outlet pipe is connected with the inlet channel and other end of the outlet pipe passes through the holding cavity; one side of the rotary plate that facing the swing arm has an outer guide groove and an inner guide groove which are in clearance fit with the guide protrusion; a first channel and a second channel are connected between the outer guide groove and the inner guide groove at intervals, the guide protrusion is able to enter the inner guide groove from the outer guide groove via the first channel and the guide protrusion is able to enter the outer guide groove from the inner guide groove via the second channel; and the second channel has a locking groove therein for locking the guide protrusion.

In some embodiments, the locking groove is a bending groove provided in the second channel.

In some embodiments, the guide protrusion is a guide cylinder.

In some embodiments, a bottom plate of the housing has a connection column, one end of the swing arm is pivotally mounted on the connection column.

In some embodiments, a terminal end of the swing arm has a support end extending towards the bottom plate, the support end is on the bottom plate.

In some embodiments, the rotary plate includes a circular groove, the outlet pipe is wound in the circular groove.

In some embodiments, the rotary plate is fitted with an adapter connected to the inlet channel, one end of the outlet pipe is connected to the adapter.

In some embodiments, the adapter includes an adapting pipe and a pipe fitting attached to one side of the adapting pipe; the rotary plate has a central sleeve in the central part, one side of the central sleeve has a sleeve notch; and the adapting pipe is installed in the central sleeve and communicated with the inlet channel, the pipe fitting protrudes from the sleeve notch and is connected with the outlet pipe.

In some embodiments, a bottom of the top cover has an insert-pipe connected with the inlet channel, the insert-pipe is inserted in the adapting pipe.

In some embodiments, a bottom of the rotary plate has a storage groove, the elastic drive member is located in the storage groove.

Advantageously, when the outlet pipe is drawn outward, the rotary plate rotates in the positive direction and compresses the elastic driving member, and the guide protrusion enters the inner guide groove from the outer guide groove via the first channel, according to some embodiments. After the user stops drawing the outlet pipe, the user can release the outlet pipe, and under the action of the elastic drive member, the rotary plate starts to rotate in the reverse direction and drive the outlet pipe to retract a certain length. During the process, the guide protrusion will enter the locking groove of the second channel from the inner guide groove to prevent the rotary plate from rotating in the reverse direction, and the outlet pipe is locked and no longer retracted. When the user needs to retract and collect the outlet pipe, the user can draw the outlet pipe again, the guide protrusion will leave the locking groove and enter the outer guide groove. The outlet pipe will be retracted automatically after the user releases it.

Thus, the application provides an improved pipe drawing mechanism with a locking function, which is convenient for users to use.

As shown in FIGS. 1-12, a retractor assembly (e.g., retractor, reel, retriever, etc.), shown as pipe drawing mechanism 0 includes a housing 1 defining a holding cavity 10 (e.g., an internal volume, a space, etc.), a top cover 2 (e.g., cover, lid, top plate, top, etc.) mounted on the housing 1 and having an inlet channel 21 (e.g., an inlet, intake, inlet port, intake port, etc.), a rotary plate 3 (e.g., spool) pivotally mounted in the holding cavity 10, a swing arm 5 (e.g., guide arm, cam arm, cam follower arm, etc.) pivotally mounted in the holding cavity 10 and having a guide protrusion 51 (e.g., a follower), a fluid conduit (e.g., flexible tube, hose, pipe, etc.) shown as outlet pipe 6 configured to be wrapped around (e.g., spooled onto, coiled onto, etc.) the rotary plate 3, and an elastic drive member 7 (e.g., spring, torsional spring, magnet, etc.) mounted in the holding cavity 10 and configured to drive the rotary plate 3 to reset (e.g., drive the rotary plate 3 to rotate toward a reset position, supply a torque to return the rotary plate 3 to a reset position). For example, the elastic drive member 7 may bias the rotary plate 3 to rotate toward a home position where the torsional spring is in a rest state (e.g., an unloaded state, a non-deformed state, etc.).

In some embodiments, one end of the outlet pipe 6 is connected to the inlet channel 21 and the other end penetrates (e.g., is external to) the holding cavity 10.

In some embodiments, an outer guide groove 31 (e.g., outer track) and an inner guide groove 32 (e.g., inner track) in clearance fit with the guide protrusion 51 are arranged on a side of the rotary plate 3 facing the swing arm 5. The rotary plate 3 may pivot about a pivot axis DD (see, FIG. 8). For example, the rotary plate 3 may be pinned within the holding cavity 10 by, for example, a portion of the housing 1 and/or the cover 2. The outer guide groove 31 may define an outer groove path (e.g., groove track, etc.) that extends around the pivot axis DD and the inner guide groove 32 may define a inner groove path (e.g., inner groove track, etc.) that extends around the pivot axis DD. A distance between the axis DD and the outer guide groove 31 may be greater than a distance between the inner guide groove 32. The outer guide groove 31 may be radially further from the pivot axis DD than the inner guide groove 32. In some embodiments, the outer guide groove 31 and the inner guide groove 32 have a circular path around the pivot axis DD. The radius of the path of the outer guide groove 31 may be larger than the radius of the path of the inner guide groove 32. In some embodiments, the inner guide groove 32 is proximate the pivot axis DD and the outer guide groove is distal the pivot axis DD. In some embodiments, the outer guide groove 31 is proximate the perimeter of the rotary plate 3. In some embodiments, the path of the outer guide groove 31 and the path of the inner guide groove 32 are concentric about the pivot axis DD.

In some embodiments, a first channel 33 (e.g., a first passage, a first ramp, etc.) and a second channel 34 (e.g., a second passage, a second ramp, etc.) are connected between the outer guide groove 31 and the inner guide groove 32. The guide protrusion 51 is able to enter the inner guide groove 32 from the outer guide groove 31 via the first channel 33, and the guide protrusion 51 is able to enter the outer guide groove 31 from the inner guide groove 32 via the second channel 34. For example, the guide protrusion 51 may travel along the groove path of the outer guide groove 31 and selectively be diverted into the inner guide groove 32 via the second channel 34.

In some embodiments, a locking groove 341 (e.g., elbow, bend, pocket, corner, catch, etc.) for locking the guide protrusion 51 is provided in the second channel 34. In some embodiments, the depth of the outer guide groove 31, the inner guide groove 32, the first channel 33 and the second channel 34 is similar. In some embodiments, the bottom surface of the outer guide groove 31, the inner guide groove 32, the first channel 33 and the second channel 34 is flat. For example, the cross section (e.g., groove profile) of the outer guide groove 31, the inner guide groove 32, the first channel 33, and the second channel 34 may be substantially uniform.

In some embodiments, the pipe drawing mechanism 0 includes a housing 1, a top cover 2, a rotary plate 3, a swing arm 5, an outlet pipe 6 and an elastic drive member 7.

In some embodiments, the top cover 2 is mounted on the housing 1 by screws, and a holding cavity 10 is formed between the housing 1 and the top cover 2. The housing 1 includes a circular bottom plate 11 and a circle of side plate mounted around the bottom plate 11, and a line outlet 12 is provided on the side plate. The top cover 2 has an inlet channel 21 arranged on it.

In some embodiments, the rotary plate 3 is connected between the bottom plate 11 and the top cover 2 by a pivoting shaft or a central sleeve, and the rotary plate 3 is rotatable in the holding cavity 10. The swing arm 5 is mounted on the bottom plate 11 by the pivot shaft, and the swing arm 5 is between the bottom plate 11 and a bottom side of the rotary plate 3. The top side of the swing arm 5 has a guide protrusion 51.

In some embodiments, the outlet pipe 6 is a soft pipe, and the outlet pipe 6 is wound on the rotary plate 3. One end of the outlet pipe 6 is communicated with the inlet channel 21 and communicated to the water path. The other end of the outlet pipe 6 extends through the line outlet 12 to the outside of the housing 1. The other end of the outlet pipe 6 can be connected to a sprayer, a faucet or a water-consuming device.

In some embodiments, the elastic drive member 7 is mounted between the bottom plate 11 and the rotary plate 3, and it is used to drive the rotary plate 3 to reset. When the user draws the outlet pipe 6, the rotary plate 3 rotates in the positive direction and the elastic drive member 7 is compressed. After the user releases the outlet pipe 6, the rotary plate 3 rotates in the reverse direction by the action of the elastic drive member 7, to wrap the outlet pipe 6 around the rotary plate 3, and the outlet pipe 6 is retracted and collected.

In some embodiments, a circle of outer guide groove 31 and a circle of inner guide groove 32 are arranged at the bottom surface of the rotary plate 3, and the inner guide groove 32 is located inside the outer guide groove 31. The inner guide groove 32 is arranged coaxially with the outer guide groove 31.

In some embodiments, the guide protrusion 51 is in clearance fit with the inner guide groove 32 and the outer guide groove 31. The guide protrusion 51 can slide in the inner guide groove 32 and the outer guide groove 31.

In some embodiments, there is a first channel 33 connected between the outer guide groove 31 and the inner guide groove 32, and the rotary plate 3 is driven to rotate in the positive direction when the outlet pipe 6 is drawn out, and the guide protrusion 51 can enter the inner guide groove 32 from the outer guide groove 31 via the first channel 33.

In some embodiments, there is also a second channel 34 connected between the outer guide groove 31 and the inner guide groove 32, and the second channel 34 and the first channel 33 are arranged at intervals. After the user releases the outlet pipe 6, the rotary plate 3 rotates in the reverse direction and the guide protrusion 51 can enter the outer guide groove 31 from the inner guide groove 32 via the second channel 34.

In some embodiments, the second channel 34 has a locking groove 341 therein for locking the guide protrusion 51 to prevent the rotary plate 3 from rotating in reverse direction, thus the outlet pipe 6 is locked in place. When the user needs to retract the outlet pipe 6, the user draws the outlet pipe 6 again, and the guide protrusion 51 will leave the locking groove 341 and enter the outer guide groove 31, and the outlet pipe 6 is automatically retracted and collected when the user releases his hand.

In some embodiments, in the pipe drawing mechanism 0, when the outlet pipe 6 is drawn out, the rotary plate 3 rotates in the positive direction and compresses the elastic drive member 7, and the guide protrusion 51 enters the inner guide groove 32 from the outer guide groove 31 via the first channel 33. When the user stops drawing the outlet pipe 6, the user can release the outlet pipe 6, and under the action of the elastic drive member 7, the rotary plate 3 starts to rotate in reverse direction and drive the outlet pipe 6 to retract a certain length. During the process, the guide protrusion 51 will enter the locking groove 341 of the second channel 34 from the inner guide groove 32 to prevent the rotary plate 3 from rotating in the reverse direction, then the outlet pipe 6 is locked and no longer retracted. When the user needs to retract the outlet pipe 6, the user draws the outlet pipe 6 again, the guide protrusion 51 will leave the locking groove 341 and enter the outer guide groove 31, and the outlet pipe 6 will be automatically retracted after the user releases it.

Thus, the application provides a pipe drawing mechanism 0 with a locking function, which is convenient for users to use.

Figure 9:
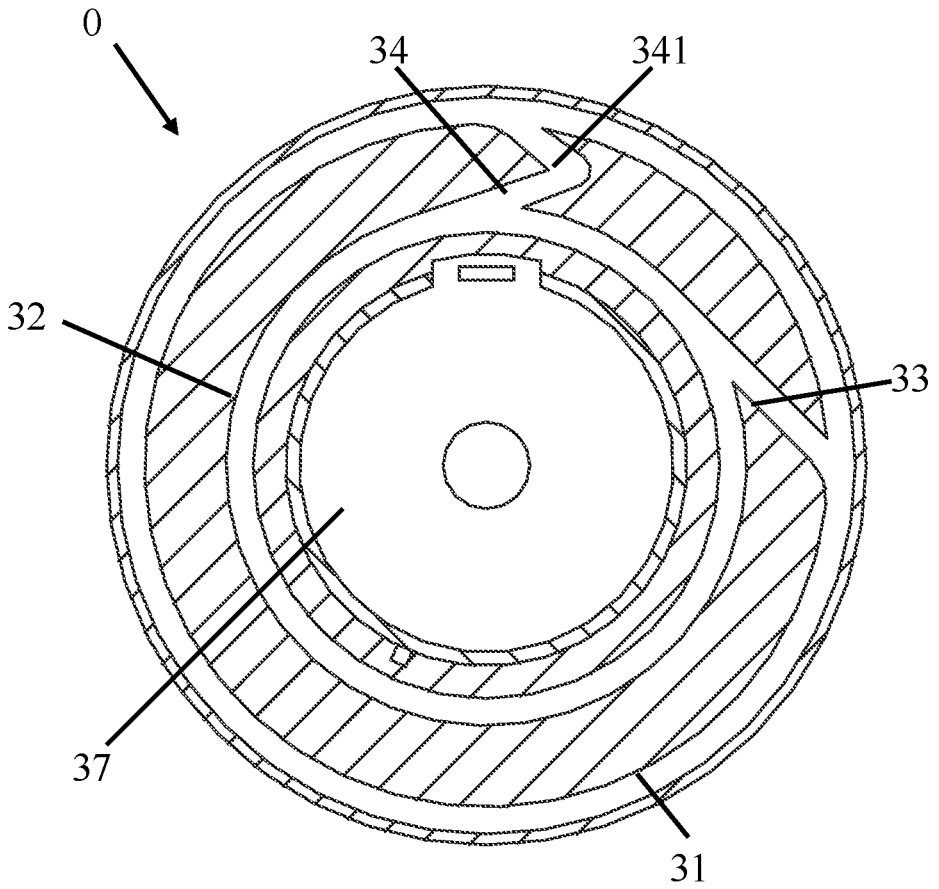
FIG. 9 is a section view of the bottom side of the rotary plate of FIG. 7 taken along line CC-CC, and showing an outer guide groove, an inner guide groove, a first channel and a second channel, according to some embodiments.

As shown in FIG. 9, the locking groove 341 is a bending groove provided in the second channel 34, according to some embodiments. The bending groove has a simple structure and can be conveniently arranged in the second channel 34. The guide protrusion 51 can be locked at a bend after the guide protrusion 51 enters the bending groove. After the user draws the outlet pipe 6 here, the guide protrusion 51 can leave the bend of the bending groove and enter the outer guide groove 31.

Figure 10:
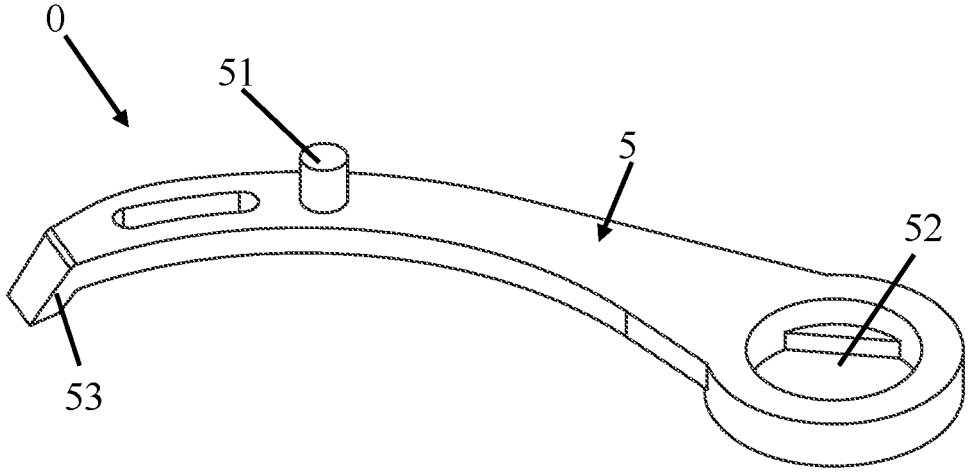
FIG. 10 is a perspective view of a swing arm of the pipe drawing mechanism of FIG. 1, according to some embodiments.
Figure 11:
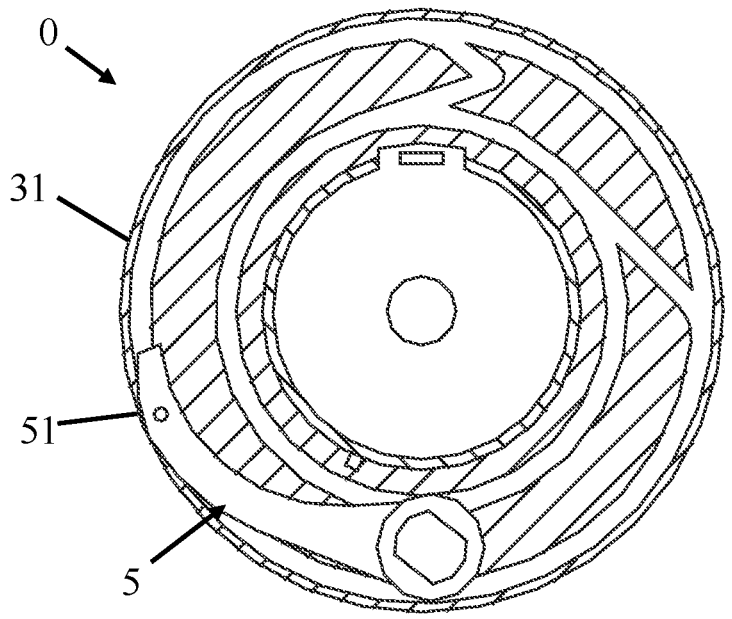
FIG. 11 is a detail view of the swing arm of FIG. 10 with a guide protrusion of the swing arm located in the outer guide groove of the rotary plate of FIG. 9 when the rotary plate is rotated in a first direction (e.g., positive direction, clockwise direction)
Figure 12:
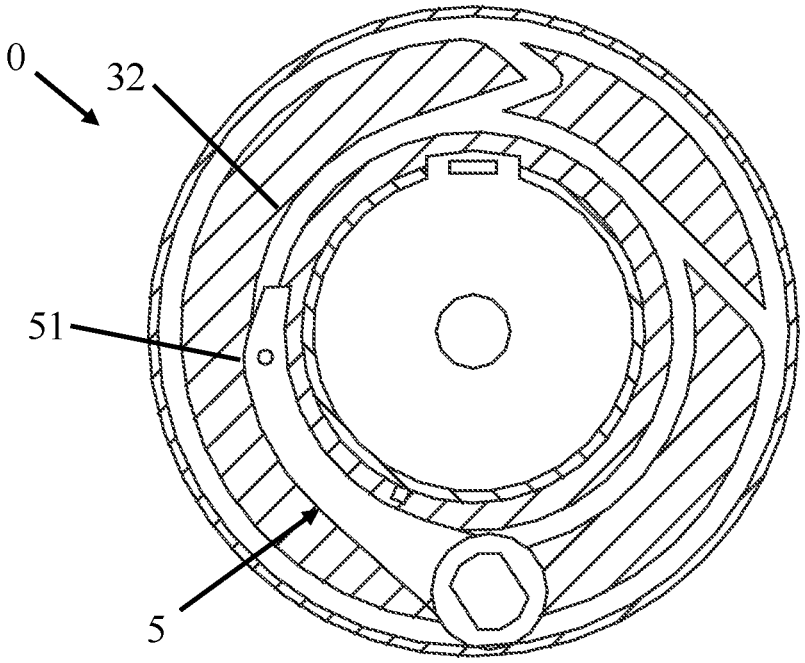
FIG. 12 is a detail view of the swing arm of FIG. 10 with a guide protrusion of the swing arm located in the inner guide groove of the rotary plate of FIG. 9 when the rotary plate is rotating in a second direction opposite the first direction (e.g., negative direction, counter-clockwise direction, reverse direction, etc.).

As shown in FIG. 10, the guide protrusion 51 is a guide cylinder, which has a small contact area and low friction with the outer guide groove 31, the inner guide groove 32, the first channel 33 and the second channel 34, which facilitates the guide cylinder to slide relative to the guide groove and channel, according to some embodiments.

Figure 2:
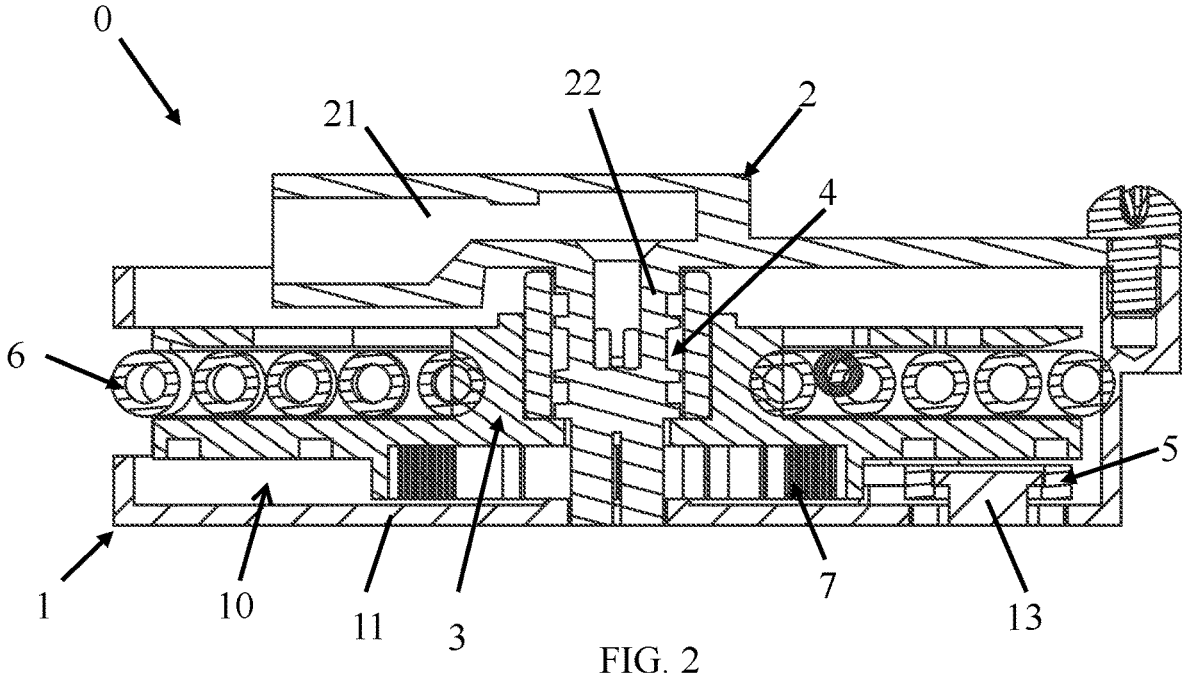
FIG. 2 is a section view of the pipe drawing mechanism of FIG. 1 taken along line AA-AA, according to some embodiments.
Figure 4:
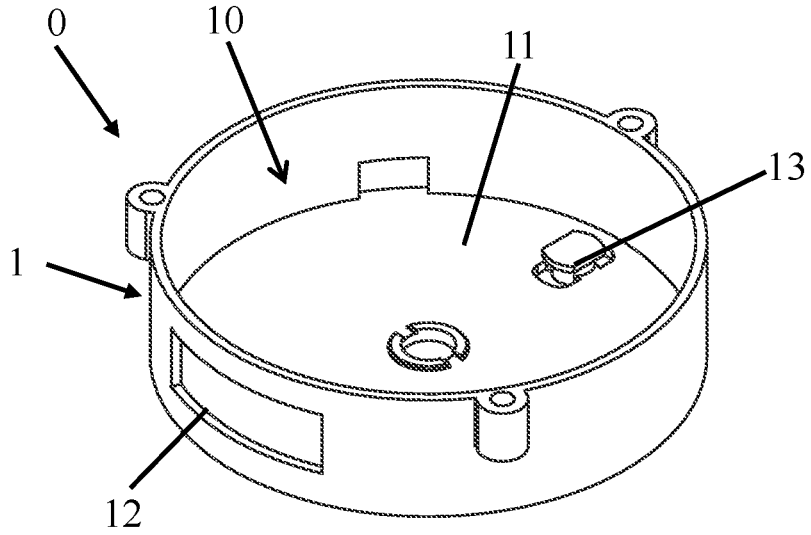
FIG. 4 is a front, right, top perspective view of a housing of the pipe drawing mechanism of FIG. 1, according to some embodiments.

As shown in FIG. 2, FIG. 4 and FIG. 10, the bottom plate 11 of the housing 1 has a connection column 13, and one end of the swing arm 5 is pivotally mounted on the connection column 13 which facilitates assembly of the swing arm 5 with the bottom plate 11, according to some embodiments. For example, the swing arm 5 may include a pivot 52 configured to engage the connection column 13 and thereby pivotally couple the swing arm 5 to the bottom plate 11 of the housing 1. The top end of the connection column 13 has an end cap (e.g., shoulder, head, etc.), which serves to prevent the swing arm 5 from separating from the connection column 13.

As shown in FIG. 10, a terminal end of the swing arm 5 has a support end 53 (e.g., support tab, tab, elbow, nib, etc.) extending toward the bottom plate 11, which is in contact with the bottom plate 11 and acts as a support to keep the guide protrusion 51 able to be in the outer guide groove 31, the inner guide groove 32, the first channel 33 and the second channel 34, according to some embodiments.

Figure 7:
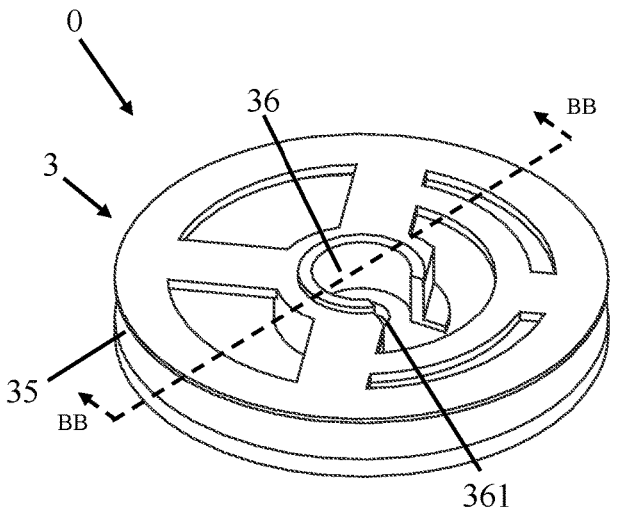
FIG. 7 is a front, right, top perspective view of a rotary plate of the pipe drawing mechanism of FIG. 1, according to some embodiments.
Figure 8:
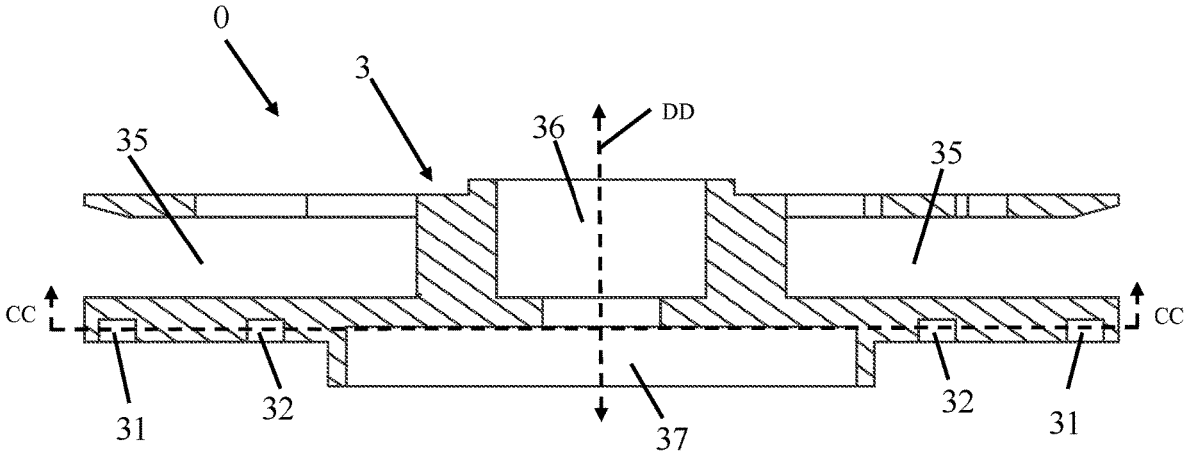
FIG. 8 is a section view of the rotary plate of FIG. 7 taken along line BB-BB, according to some embodiments.

As shown in FIG. 2 and FIGS. 7-8, the rotary plate 3 includes a circular groove 35, and the outlet pipe 6 is wound in the circular groove 35, so the stability of the outlet pipe 6 being wound on the rotary plate 3 is improved, according to some embodiments.

Figure 3:
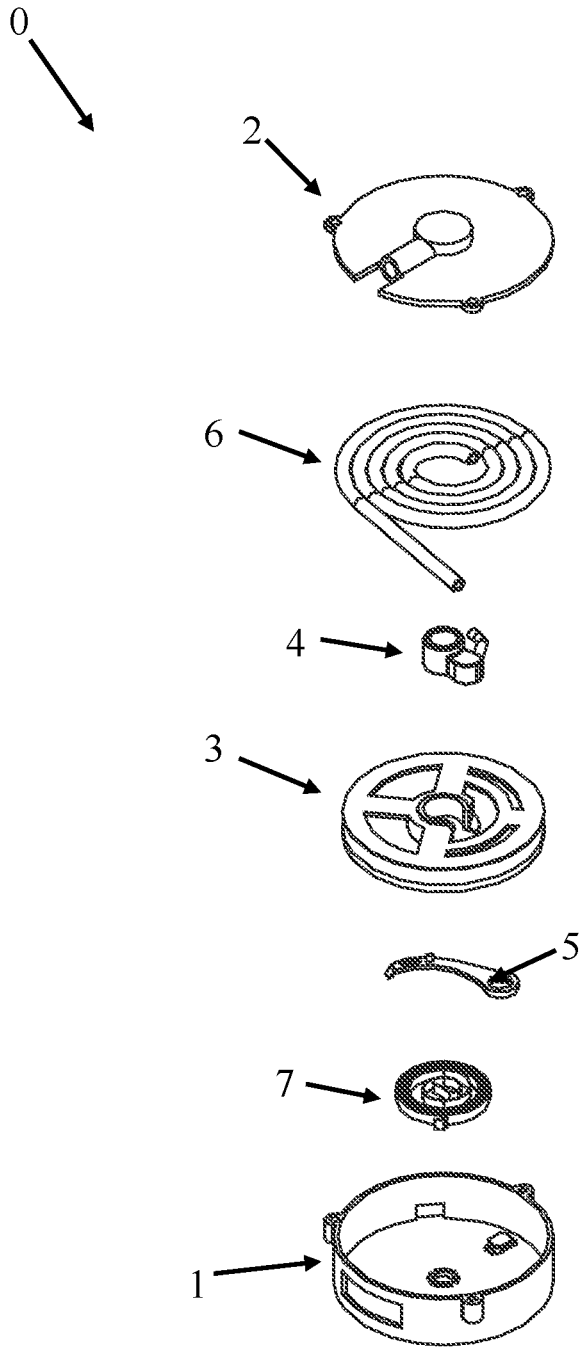
FIG. 3 is an exploded view of the pipe drawing mechanism of FIG. 1, according to some embodiments.
Figure 6:
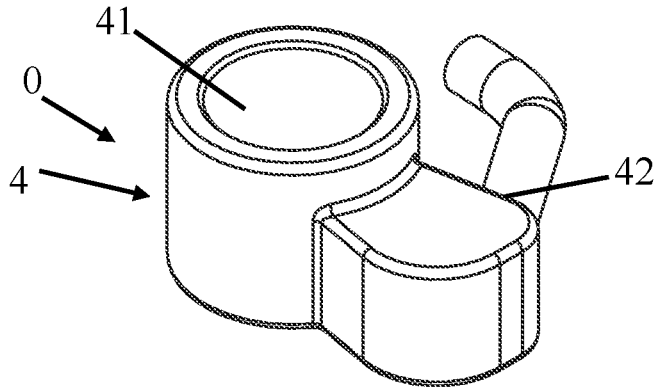
FIG. 6 is a front, right, top perspective view of an adapter of the pipe drawing mechanism of FIG. 1, according to some embodiments.

As shown in FIGS. 2-3 and FIG. 6, the rotary plate 3 is mounted with an adapter 4 that connected to the water inlet channel 21, and one end of the outlet pipe 6 is connected to the adapter 4, according to some embodiments.

Specifically, the adapter 4 is mounted on the rotary plate 3, one end of the adapter 4 is connected to the inlet channel 21, and the other end of the adapter 4 is connected to the outlet pipe 6 to facilitate the connection of the outlet pipe 6 with the water path of the inlet channel 21.

As shown in FIG. 2 and FIGS. 6-8, the adapter 4 includes an adapter tube 41 and a pipe fitting 42 attached to one side of the adapter tube 41, according to some embodiments.

In some embodiments, the rotary plate 3 has a central sleeve 36 in the central part, and one side of the central sleeve 36 has a sleeve notch 361.

In some embodiments, the adapter tube 41 is installed in the central sleeve 36 and connected with the inlet channel 21. The pipe fitting 42 extends from the sleeve notch 361 and is connected with the outlet pipe 6.

In some embodiments, the adapter 4 includes an adapter tube 41 and a pipe fitting 42, and the pipe fitting 42 is connected to one side of the adapter tube 41. The rotary plate 3 has a central sleeve 36 in the central part, and one side of the central sleeve 36 has a sleeve notch 361. When assembled, the adapter tube 41 is installed in the central sleeve 36, and the adapter tube 41 is connected with the inlet channel 21. The pipe fitting 42 extends from the sleeve notch 361, and the pipe fitting 42 is connected with the outlet pipe 6 to supply water for the outlet pipe 6.

In some embodiments, the central sleeve 36 is provided to be pivotally connected with the top cover 2 and the bottom plate 11 as needed, and the adapter 4 can rotate integrally with the central sleeve 36.

Figure 5:
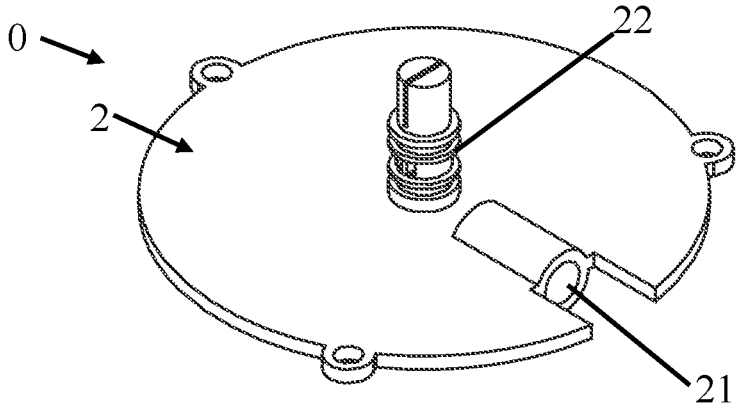
FIG. 5 is a front, bottom, left perspective view of a cover of the pipe drawing mechanism of FIG. 1, according to some embodiments.

As shown in FIG. 2 and FIGS. 5-6, the bottom of the top cover 2 has an insert-pipe 22 connected with the inlet channel 21, and the insert-pipe 22 is inserted into the adapter tube 41, according to some embodiments. The lower end of the insert-pipe 22 is closed and the portion of the insert-pipe 22 inserted into the adapter tube 41 has an outlet. Water can enter the adapter tube 41 through the outlet of the insert-pipe 22.

In some embodiments, the lower end of the insert-pipe 22 is mounted on the bottom plate 11, and the insert-pipe 22 may be the pivot shaft (e.g., pivot pin) of the rotary plate 3.

As shown in FIGS. 2-3 and FIG. 8, the bottom of the rotary plate 3 has a storage groove 37 (e.g., pocket, recess, etc.), and the elastic drive member 7 is in the storage groove 37, which can improve the assembly stability of the elastic drive member 7 and the rotary plate 3, according to some embodiments.

In some embodiments, the elastic drive member 7 is a coil spring, which has good elastic effect and is easy to assemble with the rotary plate 3 and drive the rotary plate 3 to rotate. One end of the coil spring is connected with the housing 1 and the other end is connected with the rotary plate 3.

Stated above are only principles and preferred embodiments of the present application. It should be noted that, those skilled in the art can make various other modifications based on the principle of the present application, all of which should be deemed to fall within the protection scope of the present application.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. It is important to note that any element disclosed in one embodiment may be incorporated or utilized with any other embodiment disclosed herein.

What is claimed is:

1. A retractor assembly, comprising:

a housing having a cavity;

a cover coupled to the housing and having an inlet channel;

a rotary plate pivotally mounted within the cavity;

a swing arm pivotally mounted within the cavity and having a guide protrusion;

an outlet pipe wound on the rotary plate; and an elastic drive member mounted within the cavity and configured to bias the rotary plate toward a reset position;

wherein a first end of the outlet pipe is fluidly coupled with the inlet channel and a second end of the outlet pipe passes through the housing;

wherein a side of the rotary plate includes an outer guide groove and an inner guide groove configured to receive the guide protrusion;

wherein a first channel and a second channel span between the outer guide groove and the inner guide groove;

wherein the guide protrusion is configured to enter the inner guide groove from the outer guide groove via the first channel and the guide protrusion is configured to enter the outer guide groove from the inner guide groove via the second channel; and wherein the second channel includes a locking groove therein configured to catch the guide protrusion.

2. The retractor assembly of claim 1, wherein the locking groove includes a bend in the second channel.

3. The retractor assembly of claim 1, wherein the guide protrusion is a guide cylinder.

4. The retractor assembly of claim 1, further comprising a connection column on a bottom plate of the housing, and wherein a first end of the swing arm is pivotally coupled to the connection column.

5. The retractor assembly of claim 4, wherein a terminal end of the swing arm has a support end extending towards the bottom plate, and the support end contacts the bottom plate.

6. The retractor assembly of claim 1, wherein the rotary plate comprises a radial groove, the outlet pipe is wound within the radial groove.

7. The retractor assembly of claim 1, wherein the rotary plate is fitted with an adapter fluidly coupled with the inlet channel, and the first end of the outlet pipe is coupled to the adapter.

8. The retractor assembly of claim 7, wherein the adapter comprises an adapting pipe and a pipe fitting attached to one side of the adapting pipe;

wherein the rotary plate comprises a sleeve and one side of the sleeve has a sleeve notch; and wherein the adapter is secured within the sleeve and protrudes from the sleeve notch.

9. The retractor assembly of claim 8, wherein a side of the cover includes an insert-pipe fluidly connected with the inlet channel, and wherein the adapter is configured to receive at least a portion of the insert-pipe.

10. The retractor assembly of claim 1, wherein a side of the rotary plate includes a pocket and the elastic drive member is at least partially within the pocket.

11. A retractor assembly for a plumbing conduit, comprising:

a housing defining a cavity;

a cover coupled to the housing and having an inlet channel;

a spool pivotally mounted within the cavity and configured to rotate about a spool axis;

a swing arm pivotally mounted within the cavity and having a guide protrusion;

a fluid conduit wound on the spool and comprising a first end coupled to the inlet channel; and an elastic drive member mounted within the cavity and configured to bias the spool to rotate about the spool axis toward a reset position;

wherein the fluid conduit passes through a hole in the housing between the first end and a second end of the fluid conduit;

wherein a side of the spool includes:

a first annular guide groove;

a second annular guide groove;

a first channel spanning between the first annular guide groove and the second annular guide groove; and a second channel spanning between the first annular guide groove and the second annular guide groove;

wherein the guide protrusion is configured to enter the first annular guide groove from the second annular guide groove via the first channel and the guide protrusion is configured to enter the second guide groove from the first guide groove via the second channel; and wherein the second channel includes a bend therein configured to catch the guide protrusion within the second channel.

12. The retractor assembly of claim 11, wherein the bend includes a corner provided in the second channel between the first annular guide groove and the second annular guide groove.

13. The retractor assembly of claim 11, wherein the guide protrusion is cylindrical.

14. The retractor assembly of claim 11, wherein a connection column is coupled to a bottom plate of the housing, and an end of the swing arm is pivotally coupled to the connection column.

15. The retractor assembly of claim 14, wherein a first end of the swing arm is pivotally coupled to the housing, a second end of the swing arm includes a tab extending towards the bottom plate of the housing, and the tab contacts the bottom plate of the housing when the first end of the swing arm is pivotally coupled to the housing.

16. The retractor assembly of claim 11, wherein the spool comprises a core and flanges on ends thereof, and wherein the fluid conduit is wound around the core.

17. The retractor assembly of claim 11, wherein the spool includes an adapter configured to fluidly couple the inlet channel and one end of the fluid conduit.

18. The retractor assembly of claim 17, wherein the adapter comprises an adapting pipe and a pipe fitting coupled to an end of the adapting pipe;

wherein the spool comprises a collar extending around the spool axis, wherein the collar includes a collar notch; and wherein the adapting pipe is received by the collar and the pipe fitting protrudes from the collar notch.

19. A retractor assembly, comprising:

a housing;

a spool configured to pivot about a spool axis within the housing, the spool comprising a side having:

a first annular guide groove concentric with the spool axis;

a second annular guide groove concentric with the spool axis;

a first channel spanning between the first annular guide groove and the second annular guide groove;

a second channel spanning between the first annular guide groove and the second annular guide groove;

a spring configured to bias the spool to rotate around the spool axis toward a reset position; and a follower arm pivotally coupled within the housing and including a guide protrusion configured to slide within the first annular guide groove, the second annular guide groove, the first channel, and the second channel;

wherein the side of the spool includes a recess configured to at least partially house the spring;

wherein the guide protrusion enters the first channel from the first annular guide groove when the spool is rotated in a first direction; and wherein the guide protrusion enters the second channel from the second annular guide groove when the spool is rotated in a second direction opposite the first direction.

20. The retractor assembly of claim 19, wherein the second channel of the spool includes a bend, and the guide protrusion is directed into the bend of the second channel when the guide protrusion is within the second channel and the spring biases the spool to rotate around the spool axis.

* * * * *